United States Patent [19]

Kaplan

[11] 4,246,338

[45] Jan. 20, 1981

[54] ADDITIVE COLOR PHOTOGRAPHIC FILM ASSEMBLY WITH DIFFRACTION GRATING

[76] Inventor: Sam H. Kaplan, 7141 N. Kedzie, Chicago, Ill. 60645

[21] Appl. No.: 16,903

[22] Filed: Mar. 2, 1979

[51] Int. Cl.[3] ..... G03C 1/72; G03C 1/84; G03C 7/04; G03C 7/00

[52] U.S. Cl. ..... 430/496; 430/6; 430/7; 430/367; 430/511; 350/162 R

[58] Field of Search ..... 96/24, 26, 79, 81, 117, 96/118; 430/496, 523, 511, 367, 6, 7, 946; 350/162 R

[56] References Cited

U.S. PATENT DOCUMENTS

| | | | |
|---|---|---|---|
| 747,961 | 12/1903 | Fravenfelder | 96/79 |
| 2,050,417 | 8/1936 | Bocca | 88/16.4 |
| 3,078,338 | 2/1963 | Glenn | 178/5.4 |
| 3,306,974 | 2/1967 | Cunnally | 96/118 |
| 3,719,127 | 3/1973 | Mueller | 178/5.4 CD |

OTHER PUBLICATIONS

Wall, *The History of Tri-Color Photography,* Focal Press, 1925, pp. 655–677.

"Color Separation Gratings" Damman, *Applied Optics,* vol. 17, No. 15, 8/1978, pp. 2273–2279.

"ZOD Images . . . Reproduction", Gale et al., *J. of Applied Photo. Engr.,* vol. 4, No. 2, Spring 1978, pp. 41–47.

*Primary Examiner*—Richard L. Schilling

[57] ABSTRACT

This disclosure depicts a new low cost color photographic film assembly which is of the additive type but is of very high speed due to its extremely efficient utilization of available exposure light. The assembly includes a photosensitive layer actinic to light in the entire visible bandwidth of the exposure light for recording intensity variations in light incident thereon. It includes a spectral separation phase structure comprising a pattern of periodically repetitive, wavelength-sensitive phase elements effective to deflect incident light of predetermined different colors in different directions. The phase structure is supported adjacent to the photosensitive layer and spaced therefrom by a prescribed distance which is such that each element of an image formed on the assembly is analyzed into a number of color separation elements segregated on the photosensitive layer. The image is recorded in the layer as a dissected composite of interleaved color separation elements. In a preferred arrangement the spectral separation phase structure comprises at least two interlaced sets of periodically repetitive phase elements which are characterized by their unique capability of causing light of light of the same color to be recorded in substantially coincident relationship in the photosensitive layer whereby the available film area is shared and the light utilization efficiency of the assembly thereby greatly enhanced.

22 Claims, 17 Drawing Figures

Fig. 1
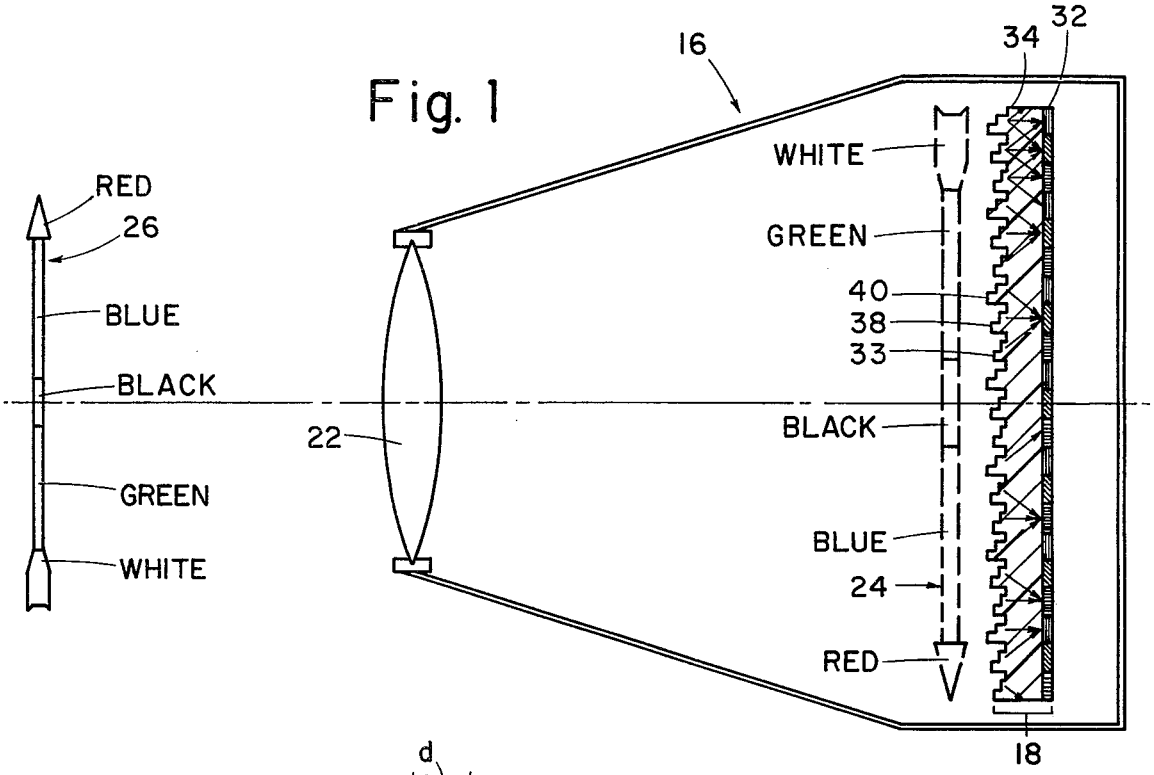
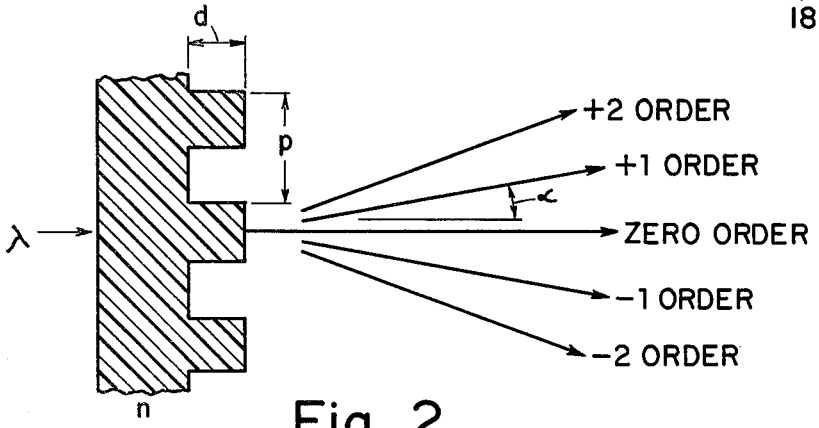
Fig. 2
PRIOR ART
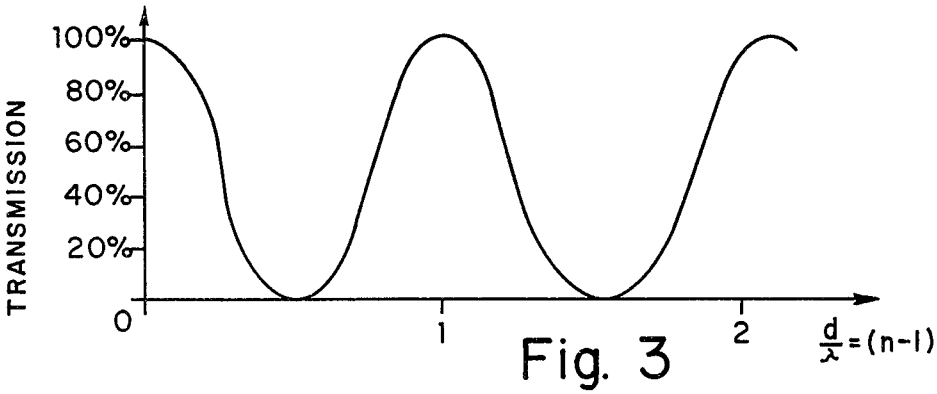
Fig. 3
PRIOR ART

ADDITIVE COLOR PHOTOGRAPHIC FILM ASSEMBLY WITH DIFFRACTION GRATING

BACKGROUND OF THE INVENTION

Color photographic systems are based either on additive or subtractive principles. Additive systems are simple and inexpensive since only a single photographic emulsion is used. They are low in optical efficiency because they use deep absorbing filters to analyze the image light into the three primary colors. These filters can absorb up to 90% of the available light. Again in viewing the finished image, as by projection, a similar amount of light is lost, resulting in a very dim picture. In subtractive systems, these large light losses do not exist and today, with one exception, all commercial systems are of the subtractive type. While the light utilization efficiency is superior in subtractive systems, these use three highly critical emulsions, and often require elaborate and complex chemistry in processing. They are therefore relatively expensive.

One well-known type of additive system is the so-called "Joly" screen plate system in which the surface of a photographic film base is covered with a fine mosaic of tri-colored filter elements upon which a silver halide emulsion is coated, typically a reversal-type film.

This invention, in a preferred execution, utilizes diffraction and dispersion phenomena. Diffraction phenomena has for decades offered the hope (as yet unrealized) of a simple, low cost color photographic system with the efficiency of monochrome systems (since no color filters need be used in either the taking or viewing processes) and with the processing simplicity and low cost of monochrome systems.

Diffraction gratings were first suggested for use in color photography by R. W. Wood in 1899. He used three superimposed gratings of different periodicity. The Wood system and other ancient diffraction-type systems are described at length in "The History Of Tri-Color Photography" by E. J. Wall, Focal Press, original published in 1925, reprinted in 1970. Later diffraction-type systems are described in patents and publications including those to Carlo Bocca (U.S. Pat. No. 2,050,417), Peter Mueller (U.S. Pat. No. 3,719,127) and William Glenn (U.S. Pat. No. 3,078,338).

In prior diffraction type systems an image is multiplied with a diffraction grating, usually by forming an image of the scene on a photosensitive emulsion against which has been placed a diffraction grating. This causes the image to modulate a spatial carrier whose frequency is that of the grating. A number of images can be additively superimposed by using gratings of different periodicity or angular orientation. To display diffraction-type recordings, the recording is placed in a projection which may have a coherent or semi-coherent light source and the separate images riding on the carriers are segregated in a space (typically termed the Fourier transform space) intermediate the projector and screen. They can be separately viewed through properly oriented and sized slits or apertures (as in the Wood system) or allowed to recombine at the viewing screen. If the images are color separations of a common scene, a full color reconstruction can be displayed by proper spatial filtering of the projected light in the Fourier transform plane and appropriate recoloring of the information by the use of Wratten filters inserted at appropriate locations in the Fourier plane. As stated by Wall at page 670 in his book (1925 edition) the diffraction process as it has been known in the past, "is an extremely beautiful use of the phenomenon of diffraction by gratings, but may be justly described as belonging to the laboratory practically for the results can only be seen by one person at a time, or to a very few, as the scale on which they can be thrown on a screen is limited by the great loss of light common to the use of all gratings."

RCA Corporation described in 1978 a process which it called ZOD (TM) which involves the use of three zeroth order gratings for red, blue and green in a subtractive-type system. These gratings are area-modulated and the finished print is made by superimposing the three embossed film gratings in registration and fusing the edges of the film. Upon reconstruction in a projector, the gratings diffract unwanted light outside the projection lens, only the undiffracted zeroth order light appearing on the screen. The ZOD process is useful only in making large numbers of copies since the masters for embossing the film gratings for each color must be made separately for each scene. For details see "ZOD Images: Embossable Surface-Relief Structures for Color and Black-and-White Reproduction" by M. T. Gab et al, *Journal of Applied Photographic Engineering*, Vol. 4, No. 2, Spring, 1978.

Another ancient process of historical interest is the prismatic dispersion processes, described by Wall in his above-identified book at page 659 et seq. In such processes an image is broken up at the image plane by a ruling. The light passing through the clear areas of the ruling is dispersed by a prismatically molded surface of diffraction grating. The spectral bands thus formed are recorded side-by-side on a photosensitive recording medium. The recording medium is usually to be developed by a reversal process and viewed in the taking instrument. These systems are extremely low in efficiency, due in large part to the great fraction of available image light absorbed by the rulings.

OBJECTS OF THE INVENTION

It is an object of this invention to provide an improved color photographic film assembly which is comparable in simplicity and cost to monochrome film assemblies.

It is another object to provide an improved color film assembly which yields a tri-color picture and yet is readily adaptable to instant type monochrome processing.

It is still another object to provide an improved additive type color photographic film assembly which is not wastefully absorptive of either taking or viewing light.

It is a specific object to provide a totally new class of photographic recording film assemblies which operate on diffraction principles but do not suffer from the inefficiencies of past diffraction-systems, making maximum use of available exposure light and photographic emulsion area.

It is thus an associated object to provide a diffraction type color photographic film assembly which is capable of being used in low light level situations and which is capable of being brightly displayed at high levels of luminous efficiency.

It is yet another object to provide a diffraction-type color photographic film which exploits the advantages of diffraction phenomena yet can be viewed in a standard projector.

BRIEF DESCRIPTION OF THE FIGURES

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

FIG. 1 is a highly schematic illustration of a photographic camera which contains a novel photographic film assembly according to this invention;

FIGS. 2–4 are schematic diagrams useful in understanding the nature of diffraction gratings;

DESCRIPTION OF THE PREFERRED EMBODIMENTS

Figure 4:
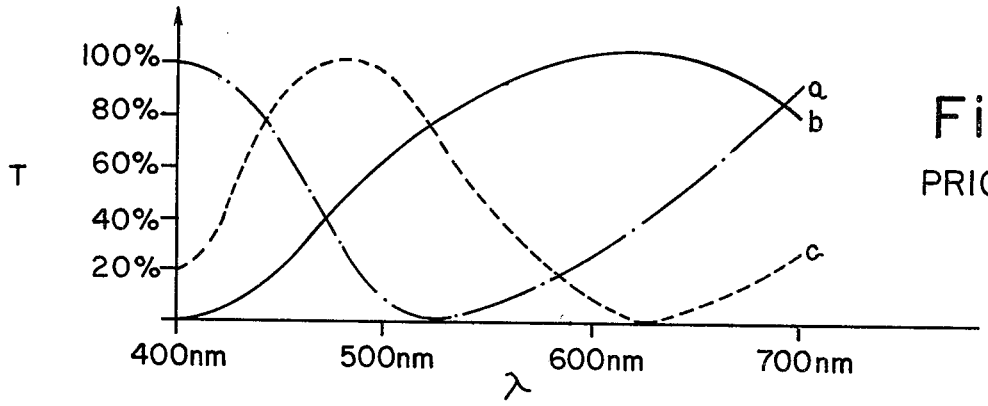
Fig. 4 PRIOR ART

FIG. 1 is a highly schematic illustration of a photographic camera 16 including a preferred embodiment of a photographic film assembly 18 according to this invention.

The camera 16 is shown as comprising a housing 20 and an objective lens 22 for forming an image 24 of an object 26 in the plane of the photographic film assembly 18. The object is shown by the labels in FIG. 1 as having different parts colored red, blue, green, black and white.

The novel photographic film assembly 18 is illustrated in schematic fashion as comprising a phase structure 34 on the base of which is supported a photosensitive layer 32. The layer is preferably of the conventional silver halide type, but may be of the vesicular type or any other type capable of recording light intensity values. It is preferably of the silver halide reversal-type for color photography, as will become obvious from the following description. The use of a reversal film makes possible simple and instant processing.

In the FIG. 1 preferred embodiment, the phase structure 34 is shown as comprising a phase diffraction grating. The phase structure lies at the heart of the present invention and will be described at length below. However, in order that the invention may be best understood, before elaborating on the phase structure, a brief background description of diffraction gratings will be given. See FIG. 2.

Notice that incoming light is diffracted into a pair of first orders (labeled "+1" and "−1"), and a pair of second orders ("+2" and "−2"). Higher diffraction orders are also present, but they are at negligibly low energy levels. Undiffracted zeroth order light remains on axis. For a given grating configuration, the percentage of light of any wavelength diffracted into any order depends upon the wavelength "λ" of the incident light, the period "p" and depth "d" of the grating, and the refractive index "n" of the grating. The diffraction angle is $\sin\alpha = N\lambda/p$, where "N" is the diffraction order. The zeroth order intensity $I_\lambda$ is:

$$I_\lambda = \cos^2\left[\frac{\pi d}{\lambda}(n-1)\right], \text{ while}$$

$$\lambda_{max} = \frac{d(n-1)}{M}, \text{ the wavelength of maximum zeroth order intensity, and}$$

$$\lambda_{min} = \frac{d(n-1)}{M-.5},$$

the wavelength of minimum zeroth order intensity. In the above, "M" is the diffraction order.

FIG. 3 shows the transmission for a zeroth order grating as a function of optical depth $d/\lambda(n-1)$. As can be seen, the transmission can be varied from 0 to 100 percent depending upon the optical depth. Light not transmitted into the zeroth order is diffracted into ±1, ±2, and higher diffraction orders.

FIG. 4 depicts theoretical zeroth order spectral transmissions for different gratings a, b, c of different optical depth. Grating "b" has the greatest optical depth grating, "a" the least. Actual transmission curves are similar in shape but slightly reduced in value.

In a preferred execution, the present invention makes use of a recently described phase grating having unique color separation capabilities. Such grating is described by H. Dammann in the Aug. 1, 1978 issue of *Applied Optics*, Vol. 17, No. 15, at page 2273, and may be termed a multi-stepped asymmetrical overphased spectral separation phase diffraction grating. This grating is described in detail in the referenced *Applied Optics* article and will be described only briefly here, particularly with reference to FIGS. 5–7. The *Applied Optics* article is incorporated by reference herein for details not given in this application.

Figure 5:
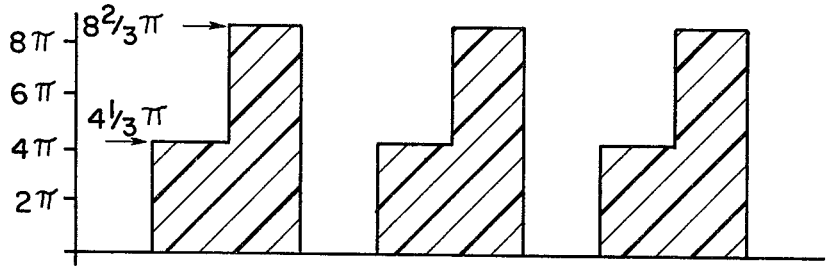
FIGS. 5–7 are schematic illustrations depicting a prior art color separation phase grating.

The Dammann grating is illustrated in FIG. 5 at 35. It is a grating of the asymmetrical stepped type to which an integral number of $2\pi$ phase delays have been added for a given wavelength. The FIG. 5 structure has the property that light of a different wavelength λ1, λ2 and λ3 will be diffracted, λ1 into the plus 1 order, λ2 into the minus 1 order and λ3 remaining on the axis in the zeroth order.

Figure 6:
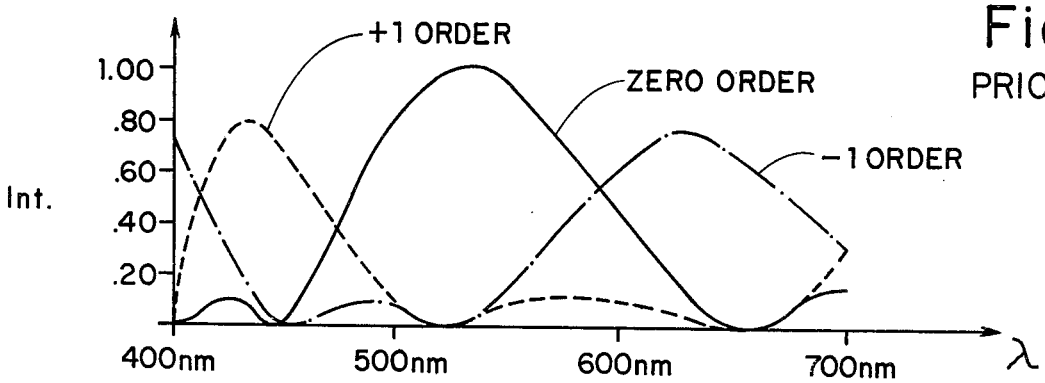
Fig. 6 PRIOR ART

FIG. 6 is a diagram depicting spectral curves for the three diffraction orders of the FIG. 5 Dammann phase grating. Dammann describes his grating as being "overphased" due to the addition of an integral number of $2\pi$ phase retardations. This grating is so designed that for a wavelength or color of the zeroth order, the optical depth is a multiple of $2\pi$ for each grating element step, while for other wavelengths or colors it will act as a blazed grating to diffract light into either the +1 or −1 order as shown in FIG. 6. FIG. 6 depicts clearly the spectral separating capability of the Dammann grating.

Figure 7:
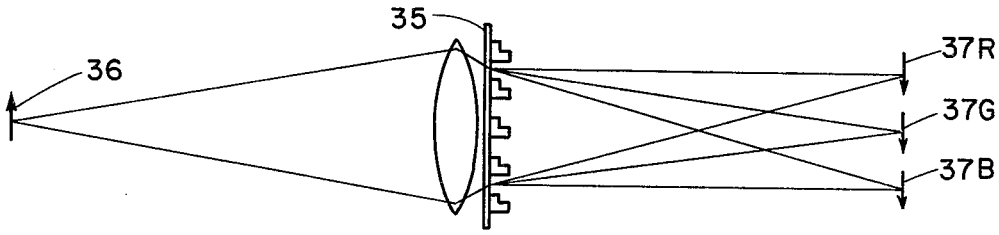
Fig. 7 PRIOR ART

The use which Dammann ascribes to the grating is that of a wavelength-sensitive beam-splitter. FIG. 7 depicts Dammann's set-up for analyzing a colored object 37 into three primary color separation images 37R, 37B, 37G, formed in coplanar spaced adjacency at the image plane. The three color separation images 37R, 37B, 37G, are isolated in space and may be separately recorded or viewed. FIGS. 5, 6 and 7 are taken from FIGS. 2, 4*a* and 11 of the Dammann article and are illustrative only.

The Dammann grating could be used in color photography by recording the three monochrome color separation images 37R, 37B, 37G, formed at the image plane. The red and blue images would be blurred, though, per Dammann, due to dispersion. After separate monochrome processing, these could be combined optically and recolored by the use of Wratten filters to reconstruct the original colored image. All the problems attending registration of separate color separations would apply.

The present invention will now be described. I have discovered that a Dammann-type phase grating may be modified and improved in a particular way and incorporated as part of a photographic film assembly so as to perform a different function and act in a quite different way than suggested by Dammann. The end result is an entirely new photographic film assembly, especially a color film assembly, which operates on diffraction principles but utilizes no color filters in either the taking or reconstruction steps, and is thus free from the light losses which so severely restrict prior art diffraction-type systems. For optimum utilization of my concept, a major modification of the Dammann phase structure itself is also required, as will be explained.

Figure 8:
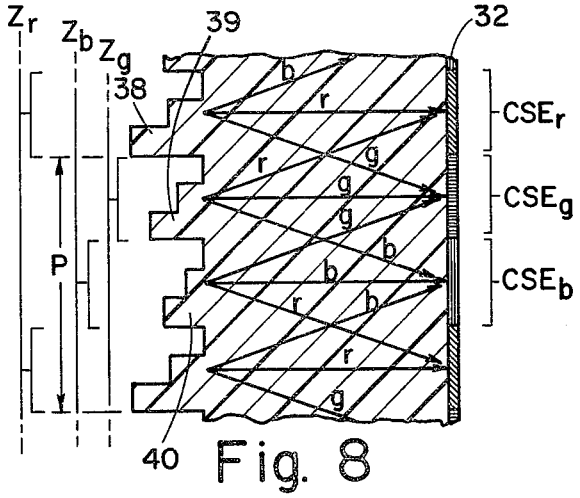
FIGS. 8 and 9 are enlargements of the novel photographic film assembly shown in FIG. 1, depicting in more detail certain principles underlying the invention.
Figure 9:
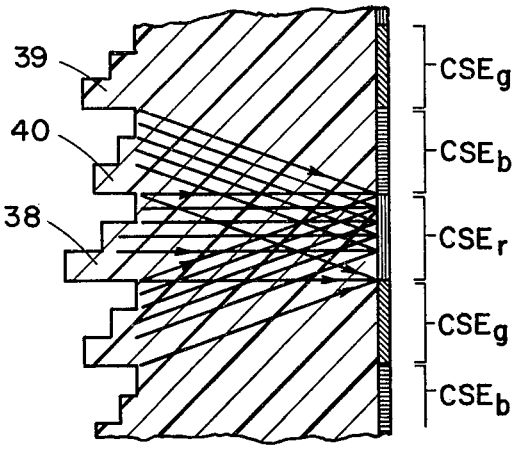

Let us turn again to FIG. 1 and the FIGS. 8-9 enlargements of the color film assembly 18 according to this invention. The film assembly 16 has a phase structure 34, which in its preferred form, is a multi-stepped asymmetrical over-phased spectral separation phase diffraction grating of such configuration and index of refraction as to diffract into one first order incident image light of a first predetermined primary color and into an opposed first order image light of a second predetermined primary color. Light of a predetermined third primary color remains in the zeroth order. The phase structure is supported adjacent the photosensitive layer 32 in plane parallel relationship therewith and is spaced therefrom by a prescribed distance which is such that each element of an image formed on the assembly is analyzed into three color separation elements which are segregated on the photosensitive layer. The image is recorded in the layer as a dissected composite of interleaved color separation elements. In the illustrated preferred embodiment the phase structure 34 is a layer of transparent material in which the grating elements which constitute the grating components are embossed. The phase structure 34 is preferably an integral part of the film assembly which includes the photosensitive layer 32.

One of the features of my invention is that for the first time a filterless recording film assembly of the additive type is able to use substantially all of the available image light and is thus much more efficient than any previous system of the additive type. This is made possible by a principle which I term "area sharing".

Area sharing is made possible by the use of a unique grating structure. Referring particularly to FIGS. 8 and 9, in the preferred tri-color film assembly embodiment, the phase structure 34 is a phase grating having interlaced grating components $Z_g$, $Z_b$ and $Z_r$. The grating components each have a period P and are phase-displaced by a P/3 which is also the phase period "p" of the grating.

The component $Z_g$ is a multi-stepped asymmetrical overphased color separation phase diffraction grating comprising grating elements 39 having a configuration and index of refraction effective to diffract blue and red light into +1 and −1 orders, leaving green light to pass straight through in the zeroth order where it is recorded on the layer 32 as a band or color separation element $CSE_g$. It should, of course, be understood that the band is not premarked on the film but is formed during the photographic exposure. In the example shown, grating element 39 directs blue light into the −1 diffraction order and red light into the +1 order.

The grating component $Z_b$ has a different phase structure from that of grating component $Z_g$. The grating elements which collectively constitute the grating component $Z_b$ are here numbered 40. They have such a configuration and phasing as to cause green and red light to be diffracted into +1 and −1 diffracted orders, respectively, passing blue light on axis into the zeroth order where it is recorded in a band or color separation element $CSE_b$ on the photosensitive layer 32.

Similarly, grating component $Z_r$ is a collection of grating elements 38 so configured and phased as to diffract blue and green light into +1 and −1 diffracted orders, respectively, causing red light to pass undiffracted and to be recorded in the photosensitive layer 32 in a band or color separation element labeled $CSE_r$. Note that the red-associated grating elements 38 are here shown as having the greatest step height, the green associated grating elements 39 as having intermediate step heights, and the blue associated grating elements 40 as having the smallest step height.

To effectuate my area sharing concept, the grating components $Z_g$, $Z_b$ and $Z_r$ have grating elements 39, 40 and 38 so structured and phased that light of common color is analyzed by the three grating components and directed to common bands on the photosensitive layer 32 where it is recorded in substantially coincident relationship. Referring to FIG. 8, we see, for example, that element 39 directs green light to neighboring color separation element $CSE_g$ and red light into neighboring color separation element $CSE_r$. Blue light is recorded in band $CSE_b$ in registration with the grating element 40.

Returning again to FIG. 1, the multi-colored object 26 is shown as being imaged on the film assembly 18. The arrows represent light which is directed to the photosensitive layer 32. Note that all three grating elements 38, 39 and 40 contribute light to the record color separation element or band associated with that color. For example, in the part of the image 24 which is green, green light is directed from each of the grating elements 38, 39 and 40 to the color separation $CSE_g$. In the portion of the image 24 which is colorless (black), there is, of course, no exposure of the layer 32. In the area of the image which is white, all three bands $CSE_g$, $CSE_r$ and $CSE_b$ are exposed.

It is extremely important to understand that all available light falling on the film assembly is utilized if it is within the overall bandwidth of the phase structure 34 (assuming that the phase structure has 100% diffraction efficiency). This is a marked departure from prior art additive systems wherein only a small fraction of the available light is utilized. By virtue of this property of area sharing, made possible by this invention, the efficiency of additive-type systems is theoretically elevated to that of subtractive systems. This fact, coupled with the simplicity and low cost of reversal-type monochrome storage materials, makes possible a mass producible, high efficiency, instant color or regular photographic system with very wide potential applicability.

The preferred embodiment of the invention illustrated in FIGS. 1, 8 and 9 may have the following specifications. The film assembly may comprise a phase structure composed, e.g., of polycarbonate material on which is coated a layer of silver halide reversal emulsion. The layer may be a standard type silver halide monochrome emulsion or it may be a so-called instant type self-developing monochrome emulsion such as used in the Polavision (TM) instant motion picture film marketed by the Polaroid Corporation of Cambridge, Mass.

The phase structure 34 is preferably composed of a layer of transparent material on which the grating elements 38, 39 and 40 are embossed. Embossing may be done by any of a variety of well known processes such as passing the film over heated rollers under pressure, one roller having the phase structure engraved or etched therein. Likewise a metal master tape having the desired phase structure may be pressed into the tape momentarily.

The system may have 1500 triads of color bands (4500 bands) per inch on the film. The bands may be horizontal, vertical, or at any selected angle, but are preferably vertical. Each color band is thus 5.64 microns with the width of each step of a two-step system as shown in FIG. 1 being 1.88 microns.

In a preferred embodiment the grating elements 38 which collectively constitute the $Z_g$ grating component have step heights of 2.1 and 4.2 microns. The $Z_b$ grating component will have elements 39 with step heights less by the ratio of wavelengths $\lambda_b/\lambda_g$ (about 6/7) or 1.8 and 3.6 microns. The $Z_r$ grating component will have elements with step heights related to the heights of the $Z_g$ grating steps by the ratio of $\lambda_r/\lambda_g$ (about 6/5), or 2.52 and 5.04 microns. It should be understood that there is considerable flexibility in the design of these grating elements insofar as the multiples of $2\pi$ factor, the wavelengths selected, and so forth.

The diffraction angle of the grating is determined by the period of the grating, which in this case is 5.6 microns.

The distances from the bottom level of the grating elements 38, 39 and 40 to the photosensitive layer 32 may, for example, in the above example be about 2.23 mils.

As noted, in the camera and in the projector the phase structure faces the source of light. It is desirable to have the film gate on the emulsion side of the film assembly to prevent scratching the phase structure. It is possible to eliminate the effects of scratching of the phase structure by fusing at the film edges a thin overlayer of clear plastic.

The photographic taking process may be as is conventional, using an objective lens with a relative aperture within the range of conventional hand-held photography. The film emulsion should be panchromatic, that is, sensitive to all colors of the visual spectrum.

Whereas the FIGS. 1, 8 and 9 embodiment described in detail above is the preferred embodiment of my invention, many other applications and embodiments are contemplated.

Figure 10:
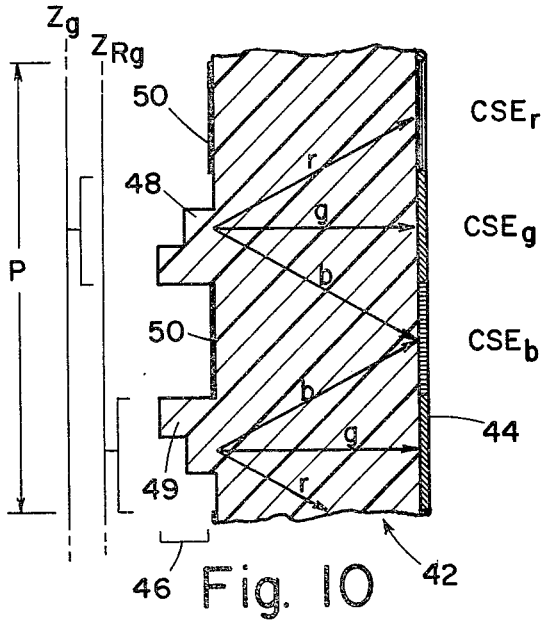
FIGS. 10–15 depict alternative embodiments of the invention.

Another embodiment which utilizes the area sharing concept, but is somewhat less efficient than the above-described embodiment is shown in FIG. 10. The FIG. 10 embodiment is shown as comprising a phase structure which includes a phase grating 46 of novel construction. A photosensitive layer 44 is disposed on the back of the phase grating 46. The grating 46 comprises first and second grating components $Z_g$ and $Z_{Rg}$. Grating components $Z_g$, $Z_{Rg}$ comprise elements 48 and 49 which are of like configuration but of reversed orientation. The components $Z_g$, $Z_{Rg}$ are spatially offset by P/2. As in the FIG. 1 embodiment the distance from the base of the grating elements 48, 49 to the photosensitive recording layer 50 is such that the color separation elements $CSE_r$, $CSE_g$, $CSE_b$ comprise registered additive contributions from both grating components. The grating elements are shown as being of such configuration and phasing as to diffract red and blue light and pass green components of the image light undiffracted into the zeroth order.

In this FIG. 10 embodiment, one-half of the area of the grating 46 is covered by light-absorptive bands 50. The FIG. 10 embodiment thus has a maximum efficiency of 50%.

Note that in this embodiment, the diffracted light components (here red and blue) are recorded in additive coincidence on bands $CSE_r$ and $CSE_b$ located behind light-absorptive bands 50. The green light components are recorded non-additively on the elements $CSE_g$. However, there are twice the number of color separation elements $CSE_g$ for green light than for either blue or red light, due to the fact that the green light is recorded non-additively. Thus the balance in recorded red, blue and green light values is preserved.

Figure 11:
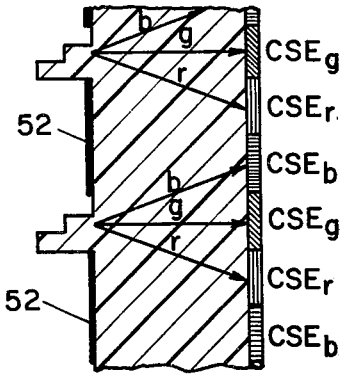

FIG. 11 illustrates yet another embodiment of the invention in which the phase structure comprises a single grating component, preferably of the aforedescribed multi-stepped asymmetrical overphased spectral separation type. In this FIG. 11 embodiment, two-thirds of the film is covered by light-absorptive bands 52. Note that there is no area sharing in this embodiment. Hence the FIG. 11 embodiment is less efficient than either the FIGS. 1 or 10 embodiments.

Figure 12:
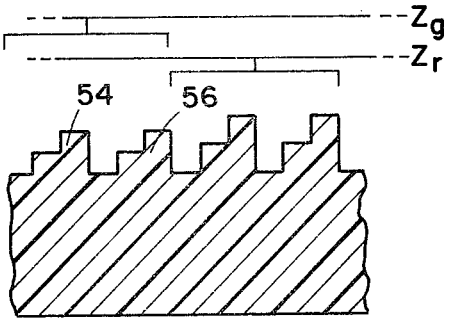

In each of the above-described embodiments the grating components $Z_g$, $Z_b$ and $Z_r$ are made up of a repetition pattern of nondivided grating elements. It is within the spirit and scope of this invention that each grating element may be broken down into two or more sub-elements. FIG. 12 illustrates an embodiment where each grating element is composed of a pair of like grating sub-elements 54, 56.

Figure 13:
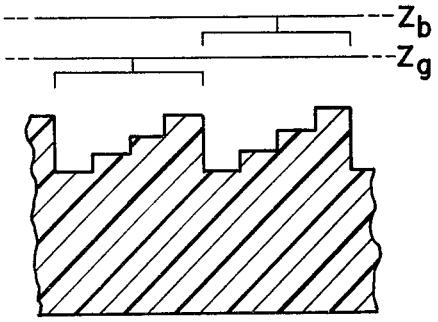

It is also contemplated that the asymmetrical multi-stepped phase structure may have more than two steps. FIG. 13 illustrates an embodiment wherein each grating element has three steps. It is contemplated that four or more steps might also be employed. As taught by Dammann, increasing the number of steps increases the efficiency of the grating.

Rather than using sharply defined steps, a Fourier sinusoidal approximation to steps may be utilized. The result of approximating the step function is a reduction in the efficiency of the grating structure. However, for reasons of manufacturing ease, it may be desirable in certain applications to permit a less well-defined grating structure.

Further, asymmetric phase structures may have elements which are trapezoidal, triangular, sinusoidal, or other shapes, without departing from the spirit of the invention. Prisms may be combined with the rectangular steps if found desirable to control the light distribution.

It should be understood that whereas the primary embodiment of the invention is a tri-color film assembly for taking and viewing photographic reproductions in natural color, the principles of this invention could be utilized, for example, in specialized photographic film assemblies for taking two or three component spectral separation photographs with color separations of selected wavelengths. Because of the lack of dyes, such films may be useful for archival purposes, as there is no dye to fade. Another specialized use is for color microfiche records.

Figure 14:
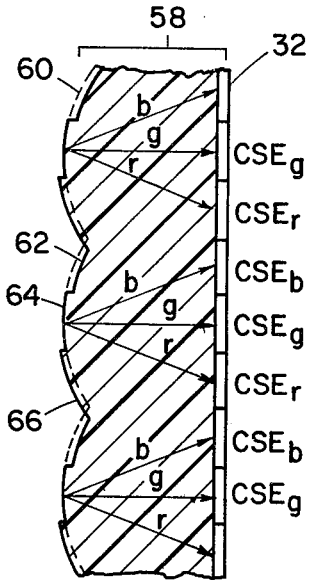

FIG. 14 illustrates an important alternative embodiment of the invention. In this embodiment the phase structure 58 has an embossed lenticular surface (illustrated partially in broken lines at 60) which is topographically modulated in synchronous repetition by a multi-stepped asymmetrical overphased spectral separation phase diffraction grating of the character described above. The steps of this grating are shown at 62, 64 and 66.

In the FIG. 14 embodiment it can be seen that, as in the preferred FIG. 1 embodiment, the elements are so configured and phased that the image light is analyzed into its three primary colors; two of these colors are diffracted into side orders while a third primary color is passed on-axis into the zeroth order. As in the FIG. 1 embodiment, the spacing of the grating elements from the photo-sensitive layer 67 is such that the image is recorded in the layer 67 as a dissected composite of interleaved color separation elements.

Unlike the FIG. 1 embodiment, there is no area sharing in the FIG. 14 embodiment. However, note that like the FIG. 1 embodiment, all available image light falling on the film assembly is utilized.

The effect of the lenticular surface is to converge the diffracted first order light such that the interleaved color separations $CSE_g$, $CSE_b$ and $CSE_g$ are spatially compressed on the film 32.

Figure 15A:
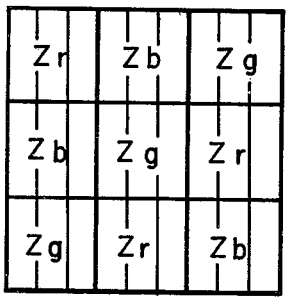
Figure 15B:
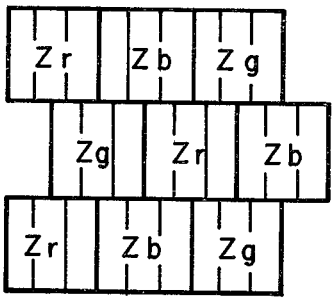

Yet other embodiments are envisioned. Whereas all of the above-described embodiments have linear or strip-type phase grating elements, it is contemplated that the principles of my invention may be used to construct a phase grating in which the strips are broken into segments and shifted by a selected spatial phase angle. In the illustrated FIGS. 15*a* and 15*b* embodiments the segments comprise two-step elements. In the FIG. 15*a* embodiment, the spatial phase shift is P/3 from segment to adjacent segment. In the FIG. 15*b* embodiment the phase shift is P/2. The useful diffraction is in the horizontal direction in FIGS. 15*a* and 15*b*.

Whereas in each of the embodiments shown the phase structure is a phase grating in relief, it may instead be a variable refractive index phase structure such as has been fabricated from dichromated gelatin in the making of holographs.

Figure 16:
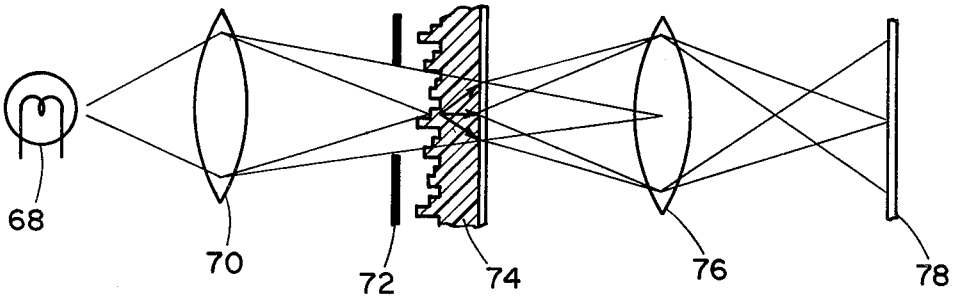
FIG. 16 illustrates in highly schematic form a projection system for viewing recordings made on my novel photographic film assembly.

FIG. 16 illustrates a conventional projection system for viewing pictures recorded on the novel photographic film assembly according to this invention. The system includes a light source 68, condensing lens 70, film gate 72, photographic record 74, projection lens 76 and screen 78. Unlike prior diffraction type systems, no spatial filtering or color filtering is necessary. It is important that the photographic record 74 is oriented in the film gate with the phase structure facing the condenser lens.

It can be seen that as the record is diffracted in exactly the same manner as was the exposure light image falling on the film assembly in the taking camera. The (white) illuminating light is analyzed into its primary color constituents. These impinge on the recorded color separation elements or bands, with light of the color associated with each element impinging on that element. For example, the blue light component of the illuminating light beam will be directed to the $CSE_b$ bands on the record. Because the film is reversal processed in the preferred execution, where the original image had blue color values, the recording emulsion will have transmissivity related to the blue light intensity. The blue constituent of illuminating light will pass through those areas and be imaged on the screen 78 by the projection lens 76.

As noted, in the preferred embodiment the phase structure forms an integral part of the film assembly and is embossed on the free surface of a transparent layer adhered to or supporting the photosensitive layer. It is possible to fabricate the phase structure on a separate substrate which is brought into contact with the recording medium and then separated for processing. The phase structure would have to be mated in very accurate registration with the photographic record for processing. It is for this reason that the integral assembly with embossed phase structure is preferred.

The additive coincidence of the light construction from the multiple grating components has been shown as having been derived from a single color triad of adjacent grating elements. It is possible to derive the coinciding components from different triads of gratings. Thus, say for a given green color separation element, the zeroth order would be derived from a registered green-associated grating element. Rather than having additional coincident green light contributions in the form of +1 and −1 diffracted orders from neighboring grating elements, the green light contributions would be received from grating elements in neighboring triads of elements.

While all descriptions have been in terms of a reversal processed photographic emulsion, it is possible to have a negative-positive type process. Proper optical means to copy the negative grating emulsion onto conventional subtractive color print film or another phase grating positive type film are needed.

Still other changes may be made in the above-described film assemblies without departing from the true spirit and scope of the invention herein involved and it is intended that the subject matter in the above depiction shall be interpreted as illustrative and not in a limiting sense.

What is claimed is:

1. A low cost, film-area-sharing, high efficiency spectral separation photographic layer assembly for recording images in incident light having a known spectral bandwidth, comprising:

a photosensitive layer actinic to light in said known bandwidth for recording intensity variations in light incident thereon; and a spectral separation phase structure comprising at least two interlaced sets of periodically repetitive, wavelength-sensitive phase elements, both sets of elements being effective to deflect in one direction incident light of a common first predetermined color and to deflect incident light of a common second color in a markedly different direction, said sets of elements differing in the direction in which light of said first and second colors is deflected said sets deflecting light of the same color on coverging paths, said phase structure being supported adjacent said photosensitive layer in plane parallel relationship therewith and spaced therefrom by a prescribed distance which is such that each element of an image formed on said assembly is analyzed into at least first and second color separation elements interleaved and segregated on said layer, and such that color separation elements of like color associated with said two sets of phase elements are recorded in substantially coincident relationship, whereby available area on said photosensitive layer is shared and the light utilization efficiency of the assembly is enhanced.

2. A low cost spectral separation photographic film assembly for recording images in incident light having a known spectral bandwidth, comprising:

a photosensitive layer actinic to light in said known bandwidth for recording intensity variations and light incident thereon; and a spectral separation phase structure comprising a pattern of periodically repetitive wavelength-sensitive phase elements effective to diffract into one non-zeroth diffraction order incident light of a first predetermined color and to diffract into an opposed diffraction order light of a predetermined second color, said structure being supported adjacent said photosensitive layer in plane parallel relationship therewith and spaced therefrom by a prescribed distance which is such that each element of an image formed on said assembly is analyzed into at least first and second color separation elements segregated on said photosensitive layer, the image being recorded in said layer as a dissected composite of interleaved elements of first and second color separations, color separation elements of like color being recorded in substantially coincident relationship, whereby available area on said photosensitive layer is shared and the light utilization efficiency of the assembly is enhanced.

3. A low-cost spectral separation photographic film assembly for recording images in incident light having a known spectral bandwidth, comprising:

a photosensitive layer actinic to light in said known bandwidth for recording intensity variations in light incident thereon; and a multi-stepped asymmetrical overphased spectral separation phase diffraction grating of such configuration and index of refraction as to diffract into one first order incident light of a first predetermined color and into an opposed first order light of a second predetermined color;

said grating being supported adjacent said photosensitive layer in plane parallel relationship therewith and spaced therefrom by a prescribed distance which is such that each element of an image formed on said assembly is analyzed into first and second color separation elements segregated on said photosensitive layer, the image being recorded in said layer as a dissected composite of interleaved elements of first and second color separations, color separation elements of like color being recorded in substantially coincident relationship, whereby available area on said photosensitive layer is shared and the light utilization efficiency of the assembly is enhanced.

4. The assembly defined by claim 3 wherein said grating comprises grating elements of period "P" and wherein said means for supporting said grating is a transparent layer with said diffraction grating carried thereon.

5. The assembly defined by claim 4 wherein said grating comprises a single grating component with grating elements of width P/3.

6. The assembly defined by claim 4 wherein said grating comprises first and second interlaced grating components of like configuration and period P, phase-displaced by P/2 and of opposite orientation, said prescribed distance and the parameters of said grating being such that said first and second color separation elements comprise additive contributions from both of said grating components.

7. The assembly defined by claim 4 wherein said grating comprises at least first and second interlaced grating components differently phased such that colors of light in the minus and plus first orders diffracted by said first grating component are different, respectively, from the colors of light in the minus and plus first orders diffracted by said second grating component.

8. The assembly defined by claim 4 wherein said grating is comprised of elements of width Wg which are subdivided into identical sub-elements of element width Wg/n, where n is an integer.

9. The assembly defined by claim 4 wherein said transparent layer having embossed thereon a lenticular pattern, the elements of said grating topographically modulating the surface of the individual lenticules in synchronous repetition, the lenticules acting to converge said diffracted first order light such that said interlaced color separation elements are spatially compressed on said film.

10. The assembly defined by claim 3 wherein said assembly includes a pattern of lenticules which converge said diffracted first order light such that said interleaved color separations are spatially compressed on said film.

11. A low cost spectral separation photographic film assembly for recording images in incident light having a known spectral bandwidth, comprising:

a photosensitive layer actinic to light in said known bandwidth for recording intensity variations in light incident thereon; and a spectral separation phase structure comprising a pattern of periodically repetitive wavelength-sensitive phase elements effective to diffract into one non-zeroth diffraction order incident light of a first predetermined color and to diffract into an opposed diffraction order light of a predetermined second color, leaving light of a third color undiffracted, said phase structure being supported adjacent said photosensitive layer in plane parallel relationship therewith and spaced therefrom by a prescribed distance which is such that each element of an image formed on said assembly is analyzed into first, second and third color separation elements segregated on said photosensitive layer, said color separation elements being associated with said diffracted light and said undiffracted light, the image being recorded in said layer as a dissected composite of interleaved elements of first, second and third color separations, color separation elements of like color being recorded in substantially coincident relationship, whereby available area on said photosensive layer is shared and the light utilization efficiency of the assembly is enhanced.

12. A low cost spectral separation photographic film assembly for recording images in incident light having a known spectral bandwidth, comprising:

a photosensitive layer actinic to light in said known bandwidth for recording intensity variations in light incident thereon; and a multi-stepped asymmetrical overphased spectral separation phase diffraction grating of such configuration and index of refraction as to diffract into one first order incident light of a first predetermined color and into an opposed first order light of a second predetermined color, leaving light of a third color in the undiffracted zeroth order, said grating being supported adjacent said layer in plane parallel relationship therewith and spaced therefrom by a prescribed distance which is such that each element of an image formed on said assembly is analyzed into first, second and third color separation elements segregated on said photosensitive layer, said color separation elements being associated with said diffracted first orders and said undiffracted zeroth order, the image being recorded in said layer as a dissected composite of interleaved elements of first, second and third color separations, color separation elements of like color being recorded in substantially coincident relationship, whereby available area on said photosensitive layer is shared and the light utilization efficiency of the assembly is enhanced.

13. The assembly defined by claim 12 wherein said grating has elements of width $W_g$ and period P, and wherein said color separation elements which collectively constitute said color separations each have a like period P and a width substantially equal to $W_g$.

14. The assembly defined by claim 12 wherein said assembly is a color film assembly and said color separations are in the red, blue, and green regions of the visual spectrum.

15. The assembly defined by claim 12 wherein said grating comprises first and second interlaced grating components of like configuration and period P, but phase-displaced by P/2 and of opposite orientation, said prescribed distance and the parameters of said grating being such that said interleaved first and second color separations on said layer comprise substantially coincident contributions from both of said grating components.

16. The assembly defined by claim 12 wherein said grating comprises first, second and third interlaced grating components of like period P, phase displaced by P/3, each of which components analyzes incident light image elements into first, second and third color separation elements corresponding to three primary visual colors, the three colors for the three grating components being substantially the same, said grating components being of predetermined different phasing which is such that the color of the plus first order light of a first of said grating components is substantially the same as both the minus first order light of a second of said grating components and the zeroth order light of the third of said grating components, the color separation elements of a common color produced by said three grating components being recorded in substantially coincident additive relationship on said photosensitive layer.

17. The assembly defined by claim 16 wherein said assembly includes a pattern of lenticules which converge said diffracted first order light such that said interleaved color separation elements are spatially compressed on said layer.

18. The assembly defined by claim 17 wherein said means for supporting said grating is a transparent layer on said photosensitive layer which has embossed thereon a lenticular pattern, the elements of said grating topographically modulating the surface of the individual lenticules in synchronous repetition.

19. A low cost color photographic film assembly for recording images in incident light having a full visual spectral bandwidth, comprising:

a high resolution panchromatic photosensitive layer for density recording intensity variations in light incident thereon; and a transparent layer on said photosensitive layer having embossed thereon a multi-stepped asymmetrical overphased color separation phase diffraction grating, said grating comprising three interlaced grating components of like period P, phase-displaced by P/3, each of which components analyzes incident light image elements into red, green and blue color separation elements, said grating components being of predetermined different phasing which is such that the color of the plus first order light of a first of said grating components is substantially the same as both the minus first order light of a second of said grating components and the zeroth order light of the third of said grating components, said transparent layer being of such thickness that said grating is spaced from said photosensitive layer by a prescribed distance which is such that said color separation elements are segregated on said photosensitive layer, the dimensions and parameters of said assembly being such that the color produced by said three grating components are recorded in substantially coincident relationship on said photosensitive layer.

20. The assembly defined by claim 19 wherein each of said grating components and the color separation elements produced thereby have a period P and width P/3, and wherein blue color separation elements produced as a plus first order, minus first order, and zeroth order from first, second and third grating components, respectively, are additively recorded in coincident relationship on said photosensitive layer.

21. The assembly defined by claim 20 wherein each of said grating components has elements each of width $W_g$ which are subdivided into identical sub-elements of element widths $W_g/n$ where "n" is an integer.

22. A low cost spectral separation photographic film assembly for recording images in incident light having a known spectral bandwidth, comprising:

a photosensitive layer actinic to light in said know bandwidth for recording intensity variations in light incident thereon; and a transparent layer on said photosensitive layer which carries a pattern of lenticules topographically modulated by a multi-stepped asymmetrical overphased spectral separation phase diffraction grating of such configuration and index of refraction as to diffract into one first order incident light of a first predetermined color and into an opposed first order light of a second predetermined color, said layer being of such thickness as to space said grating a prescribed distance from said photosensitive layer which is such that each element of an image formed on said assembly is analyzed into first and second color separation elements segregated on said photosensitive layer, the image being recorded in said photosensitive layer as a dissected composite of interleaved elements of first and second color separations, said lenticules acting to converge said diffracted first order light such that said interleaved color separation elements are spatially compressed on said photosensitive layer.

* * * * *